US006256871B1

(12) United States Patent
Bunnell et al.

(10) Patent No.: US 6,256,871 B1
(45) **Date of Patent: *Jul. 10, 2001**

(54) CRIMPING APPARATUS FOR ELECTRICAL CONNECTORS

(75) Inventors: Ed Bunnell, Clearwater; Robert DeRoss, Palm Harbor; John Grosjean, St. Petersburg; John MacNeil, St. Petersburg; Robert Quinn, St. Petersburg, all of FL (US)

(73) Assignee: Molex Incorporated, Lisle, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/430,101

(22) Filed: Oct. 29, 1999

(51) Int. Cl.[7] ..... H01R 43/04

(52) U.S. Cl. ..... 29/753; 29/751; 29/33 M; 29/857; 29/861; 29/863; 72/409.06; 72/427

(58) Field of Search ..... 29/753, 751, 449, 29/33 M, 857, 863, 861; 72/409.04, 409.06, 427

(56) References Cited

U.S. PATENT DOCUMENTS

| | | | | |
|---|---|---|---|---|
| 3,427,852 | * | 2/1969 | O'Loughlin et al. | 72/409.06 |
| 4,236,302 | | 12/1980 | Kuehling | 29/753 |
| 4,489,589 | | 12/1984 | Kirsinas et al. | 72/424 |
| 5,054,191 | | 10/1991 | Schule | 29/753 |
| 5,385,434 | | 1/1995 | Quinn et al. | 406/73 |
| 5,687,613 | | 11/1997 | Swedberg | 72/424 |

* cited by examiner

*Primary Examiner*—Lee Young
*Assistant Examiner*—Rick Kiltae Chang
(74) *Attorney, Agent, or Firm*—Stephen Z. Weiss

(57) ABSTRACT

An apparatus is provided for crimping a crimpable connector onto at least one electrical conductor. The apparatus includes a pair of crimping arms defining a staging area behind a crimping area. The staging area allows a first connector to be fed thereto and moved to the crimping area to be crimped thereat. A second connector is fed to the staging area, and an ejector moves the second connector into engagement with the first connector to eject the first connector from the crimping area while the second connector moves into the crimping area.

16 Claims, 13 Drawing Sheets

CRIMPING APPARATUS FOR ELECTRICAL CONNECTORS

FIELD OF THE INVENTION

This invention generally relates to the art of electrical connectors and, particularly, to an apparatus for crimping a crimpable connector onto at least one electrical conductor.

BACKGROUND OF THE INVENTION

Generally, electrical connectors are used to interface one electrical conductor to another conductor. The conductors may be terminated to respective terminals or contacts and the terminals, in turn, may be interengaged by the connector. In other connectors, a pair of conductors may be connected directly to each other without employing terminals or contacts.

In the latter situation, above, two conductors often are connected directly to each other by using a crimpable conductive component such as a sleeve. The conductors are inserted into the sleeve, and the sleeve is crimped or deformed to clamp the conductors therebetween to mechanically and electrically join the conductors. The sleeve may be encased by a dielectric tube or cup.

A wide variety of assembly, terminating or crimping apparatus or tools are used for assembling, terminating or otherwise interfacing an electrical connector with the conductors to be joined. Such apparatus can range from fully automated machines which are quite elaborate and very expensive, to semi-automatic apparatus to simple manually operated tools such as crimping pliers. The present invention is directed to semi-automatic apparatus, particularly a crimping apparatus for crimping a connector to join a pair of electrical conductors, such as the ends of a pair of electrical wires. Heretofore, such crimping apparatus have been unduly complicated and unreliable. Particularly when the connectors are mechanically or otherwise fed to the apparatus, jamming continues to be a major problem. The present invention is directed to solving the problems of semi-automatic crimping apparatus in a relatively simple and inexpensive hand-operated tool.

SUMMARY OF THE INVENTION

An object, therefore, of the invention is to provide a new and improved apparatus of the character described, particularly for crimping a crimpable connector onto at least one electrical conductor.

In the exemplary embodiment of the invention, the apparatus includes a pair crimping arms defining a staging area behind a crimping area, with a pair of opposing crimping jaws on opposite sides of the crimping area. The arms are movable between open and closed positions to move the jaws between loading and crimping positions, respectively. The arms in the open position (the loading position of the jaws) allow a first connector to be fed from the staging area to the crimping area. The jaws in the closed position (the crimping position of the jaws) block the staging area to prevent a second connector from being fed thereto while the first connector is being crimped. Means provided for moving the crimping arms between their positions. Means are provided for feeding connectors seriatim to the staging area. An ejector is provided for engaging the second connector fed to the staging area when the crimping arms are open and for moving the second connector from the staging area to the crimping area into engagement with the first connector to eject the first connector from the crimping area while the second connector moves into the crimping area.

As disclosed herein, means are provided for pivotally mounting the crimping arms for relative movement between their open and closed positions. The staging area is defined by an open area between the pivoted crimping arms behind the opposing crimping jaws. The open area is dimensioned to be narrower than one of the connectors when the crimping arms are in their closed position. The open area is at least as wide as one of the connectors when the crimping arms are in their open position.

The means for moving the crimping arms in the preferred embodiment comprise a piston and cylinder device. The means for moving the ejector also comprise a piston and cylinder device. The means for feeding the connectors include a hollow tube leading to the staging area.

Means are provided for moving the ejector from a retracted position to an extended position to effect moving the second connector from the staging area to the crimping area and ejecting the first connector from the crimping area. The ejector is moved back to its retracted position as the crimping arms are moved to their closed position to move the jaws into crimping position against the second connector.

Another feature of the invention is the provision of a spring loaded collet at the front of the crimping area for releasably holding the first connector in the crimping area during crimping. The spring loaded collet allows the first connector to be pushed out of the collet by the second connector after crimping. As disclosed herein, the spring loaded collet comprises a split collet surrounded by a resilient ring.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
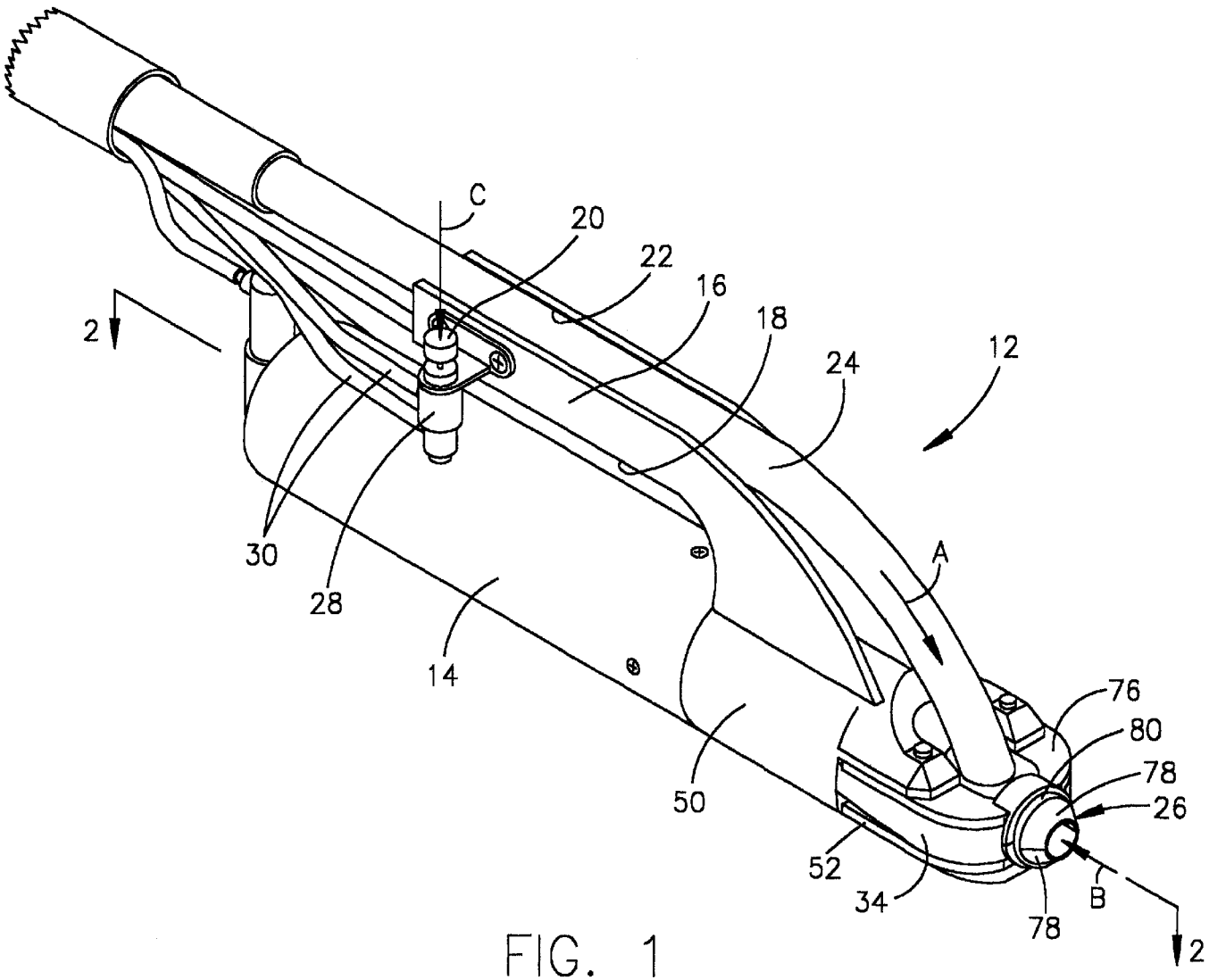
FIG. 1 is a perspective view of a crimping apparatus embodying the concepts of the invention.

Referring to the drawings in greater detail, and first to FIG. 1, the invention is embodied in a semi-automatic, hand-held apparatus, generally designated 12, for crimping a crimpable connector (described in relation to FIGS. 5–11) onto at least one electrical conductor. As described herein, the connector is crimpable onto a pair of electrical conductors to mechanically and electrically join the conductors. The apparatus includes a cylindrical housing 14 with an overlying handle 16 located such that an operator can insert his or her fingers into a space 18 between the handle and the cylindrical housing and with the operator's thumb in position for depressing an actuator button 20. Handle 16 is in the form of a trough defining a channel 22 within which a connector feeding tube 24 is positioned. As will be seen hereinafter, connectors are fed through the tube in the direction of arrow "A" to a staging area of the apparatus, as described hereinafter. Conductors are inserted into a connector held by a collet, generally designated 26, in the direction of arrow "B", again as described hereinafter.

Still referring to FIG. 1, actuator button 20 actuates a pneumatic valve 28 connected to a pair of pneumatic lines 30 leading to the main controls of the apparatus. When it is desired to crimp a connector onto a pair of conductors, the operator depresses actuator button 20 in the direction of arrow "C" to start a cycle of operation of apparatus 12.

Figure 2:
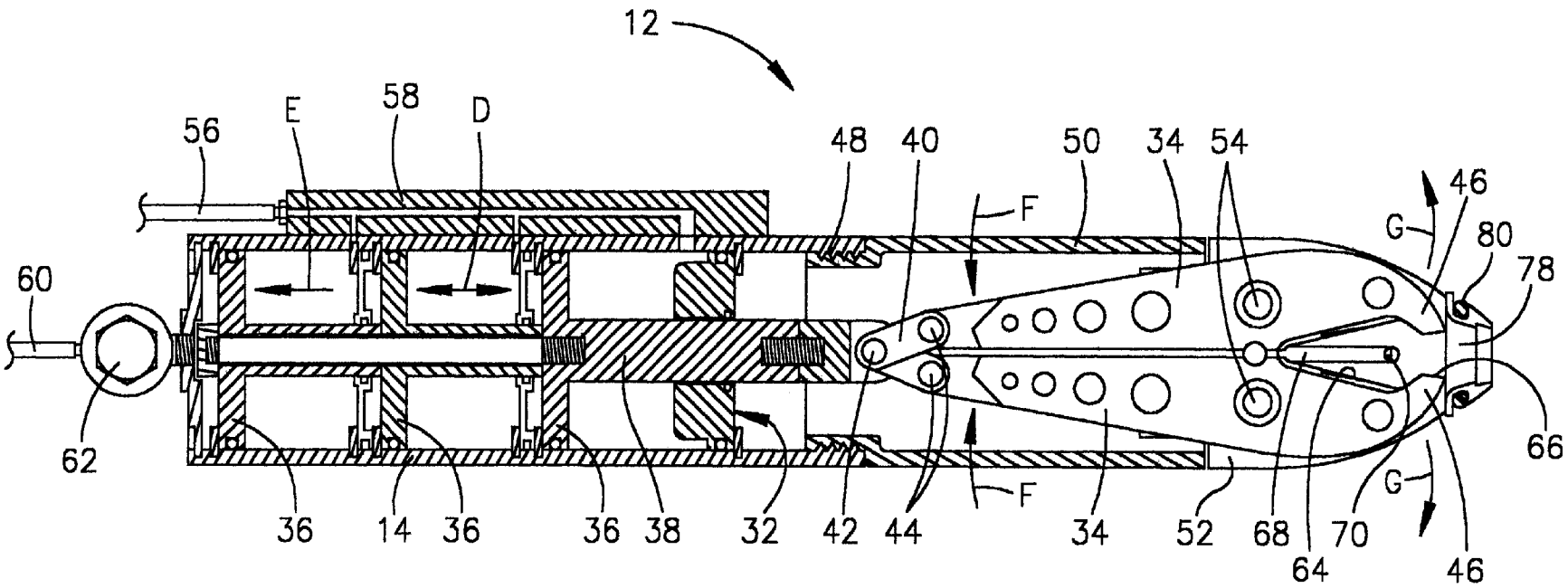
FIG. 2 is a horizontal section taken generally along line 2—2 of FIG. 1, with the crimping arms in their open position, the jaws in their loading position and the ejector in its extended position.
Figure 3:
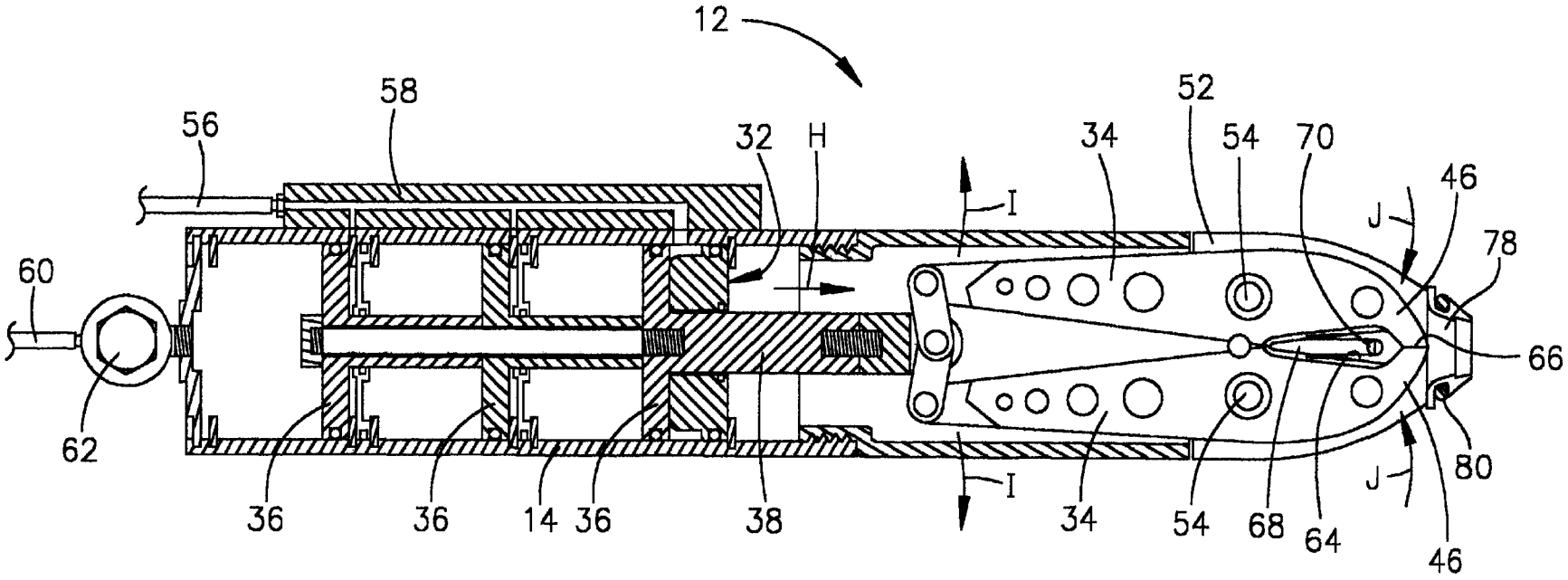
FIG. 3 is a view similar to that of FIG. 2, with the crimping arms in their closed position, the jaws in their crimping position and the ejector still in its extended position.

Referring to FIGS. 2 and 3 in conjunction with FIG. 1, cylindrical housing 14 actually forms the cylinder of a piston and cylinder device, generally designated 32 which is used to operate a pair of crimping arms 34. The piston and cylinder device includes plural pistons 36 connected to a piston rod 38, and this subassembly is reciprocal within cylinder 14 in the direction of double-headed arrow "D" (FIG. 2). Piston rod 38 is connected by a pair of links 40 which are pivoted at 42 to piston rod 38 and which are pivoted at 44 to the inside distal ends of crimping arms 34. The crimping arms have a pair of opposing crimping jaws 46 at the opposite or outer ends thereof. Cylinder 14 is threadingly connected, as at 48, to a cylinder extension 50 which is fixed to an outside mounting plate 52. Crimping arms 34 are pivotally mounted to mounting plate 52 by a pair of pivot posts or bolts 54.

Still referring to FIGS. 2 and 3, pneumatic fluid or air is admitted to cylinder 14 to the right-hand side of pistons 36 as viewed in the drawings through a line 56 and a manifold 58. Pneumatic fluid or air is admitted to the left-hand side of the left-most piston 36 through a line 60 and a quick exhaust valve 62. With this arrangement, crimping arms 34 are moved to their open position as shown in FIG. 2 by admitting pressurized air into cylinder 14 to the right-hand side of pistons 36 through line 56 and manifold 58 to move the pistons and piston rod 38 to the left in the direction of arrow "E" (FIG. 2). Air is returned out of the cylinder through the quick exhaust valve 62. When the pistons and piston rod move in the direction of arrow "E", the inner ends of crimping arms 34 are pulled inwardly in the direction of arrows "F" (FIG. 2) through links 40 which are pivotally connected between the piston rod and the crimping arms. This action causes opposed crimping jaws 46 to move outwardly in the direction of arrows "G" to loading positions where the jaws are spread apart. At this point, it should be understood that crimping arms 34 define a staging area in the form of an open area 64 immediately behind a crimping area 66 defined between the opposing crimping jaws.

Referring to FIG. 3, pressurized air is admitted to cylinder 14 through line 60 and quick exhaust valve 62 as air is returned through line 56 and manifold 58 in order to move pistons 36 and piston rod 38 to the right or in the direction of arrow "H". This causes the inner ends of crimping arms 34 to move outwardly in the direction of arrows "I" as crimping jaws 46 move inwardly in the direction of arrows "J". FIG. 3 represents the closed position of crimping arms 34 and a crimping position of jaws 46. In the crimping position, the jaws abut each other to provide a stop limit means to prevent over crimping of the connectors. As will seen hereinafter, the opposing faces of the jaws are recessed to accommodate the connectors. It should be noted that in the open position of crimping arms 34 shown in FIG. 2, staging area 64 between the arms immediately behind crimping area 66 is considerably wider than the staging area shown in FIG. 3 when the crimping arms are moved to the closed position.

Finally in regard to FIGS. 2 and 3, an ejector arm 68 extends beneath staging area 64 and terminates in an ejector pin 70 which projects into the staging area. The operation of the ejector will be described hereinafter.

Figure 4:
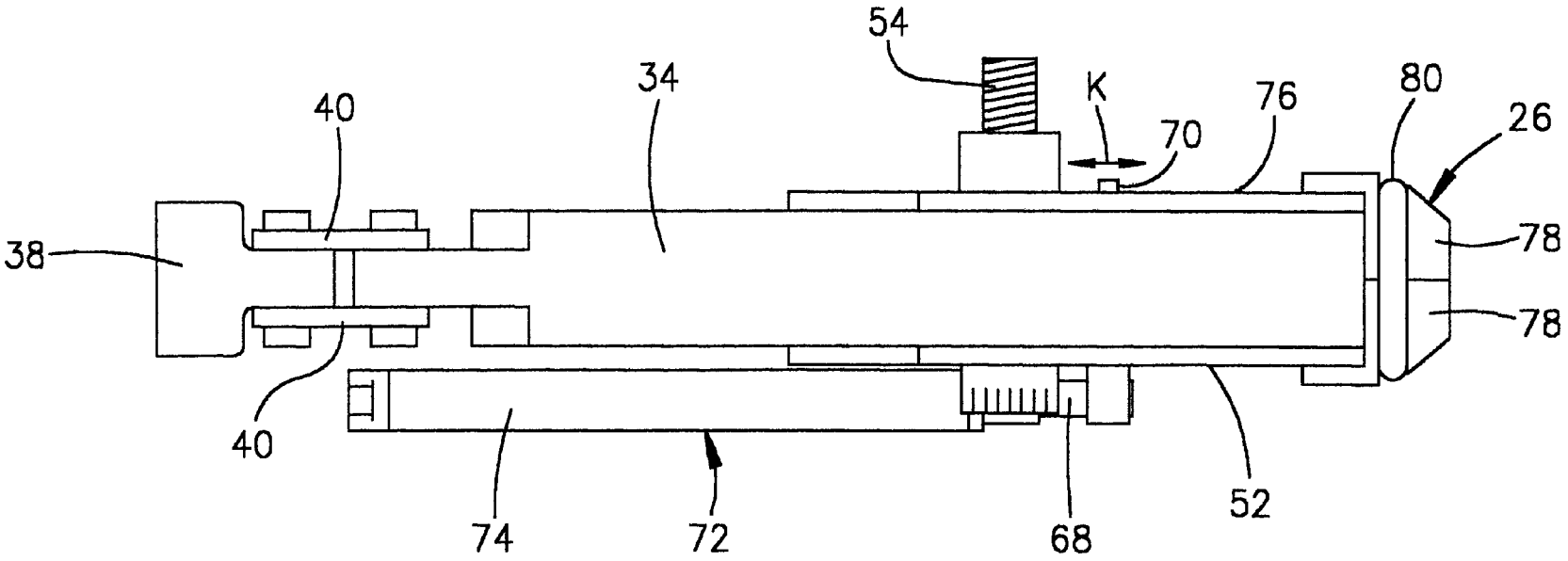
FIG. 4 is a side elevational view of the subassembly of the crimping jaws and ejector.

Referring to FIG. 4 in conjunction with FIGS. 2 and 3, it can be seen that ejector arm 68 projects from one end of a piston and cylinder device, generally designated 62, mounted below mounting plate 52. The piston and cylinder device includes an outer cylinder 74 and an inner piston (not shown) connected by an appropriate piston rod to ejector arm 68. Selective admission of pressurized air to opposite sides of the piston causes ejector pin 70 to move in the direction of double-headed arrow "K" (FIG. 4). FIG. 4 also shows a second mounting plate 76 above crimping arms 34, whereby the crimping arms are sandwiched between mounting plates 52 and 76 with sufficient play to allow the arms to freely pivot or move between the plates.

Figure 5:
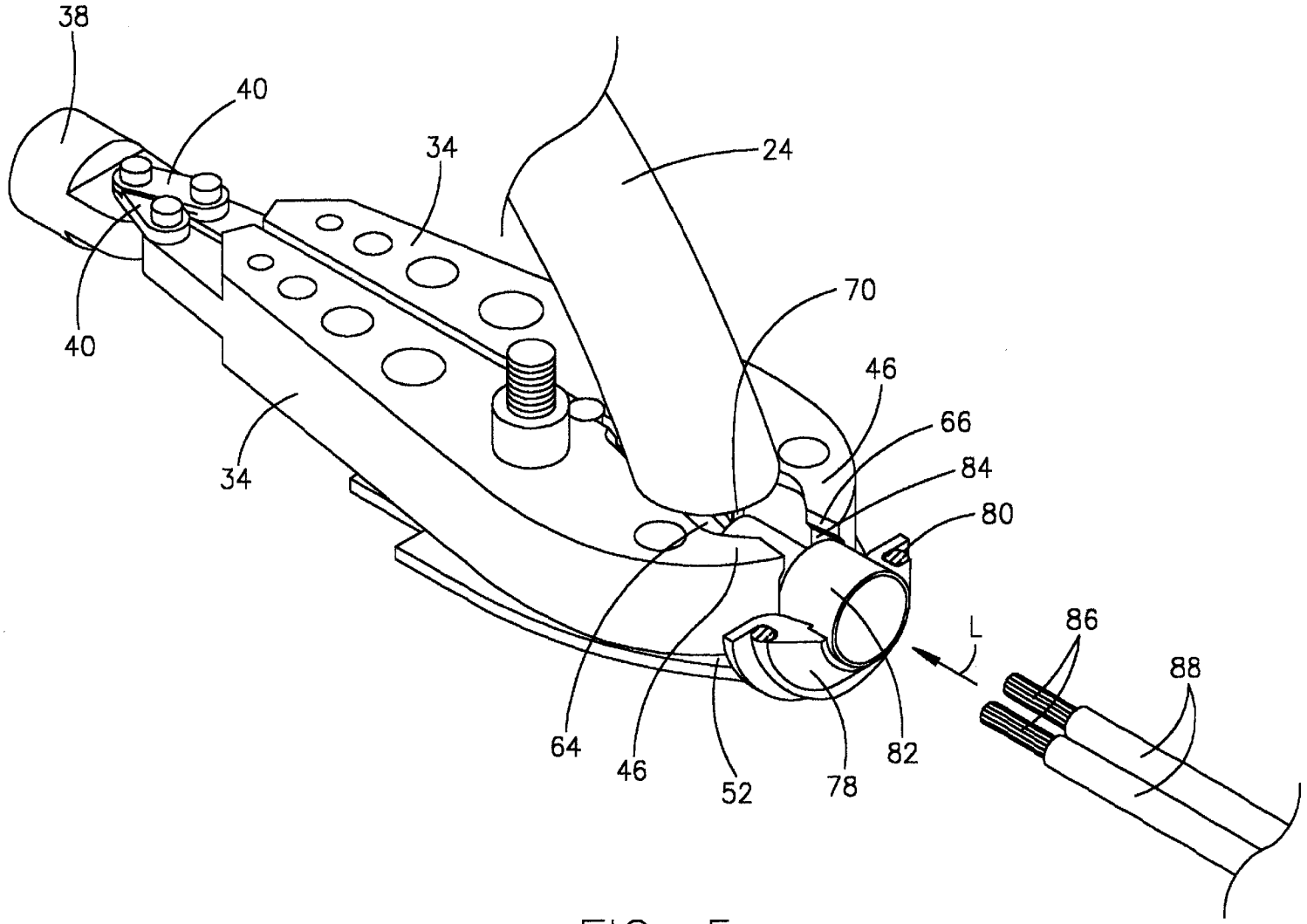
FIGS. 5–11 are sequential perspective views of the crimping arms, jaws and ejector in conjunction with a feeding tube, various connectors and conductors to illustrate the sequence of operation of the apparatus.

Referring to FIGS. 4 and 5 in conjunction with FIGS. 1–3, collet 26 is a split collet including a pair of collet halves 78 surrounded by a resilient ring, such as a rubber O-ring 80. As will be understood hereinafter, this expandable collet can be used to releasably grip an electrical connector 82 (FIG. 5) while allowing the connector to be pushed out of the collet.

Sequential reference now will be made to FIGS. 5–11 to describe the operation of the apparatus. Specifically, FIG. 5 shows a connector 82 having been moved by ejector pin 70 to crimping area 66 between opposing jaws 46. Crimping arms 44 are in their open position (FIG. 2) which corresponds to the loading position of jaws 46. The connector was moved from staging area 64 to crimping area 66 by ejector pin 70 while the crimping arms are open. FIG. 5 shows that the inside faces of jaws 46 are recessed, as at 84, to accommodate the connector which may be a closed end connector fabricated of crimpable material. On the other hand, the connector may have a crimpable metal liner surrounded by a dielectric cup. In any event, the exposed conductors 86 of a pair of electrical wires 88 are shown prepared for insertion into the connector in the direction of arrow "L".

Figure 6:
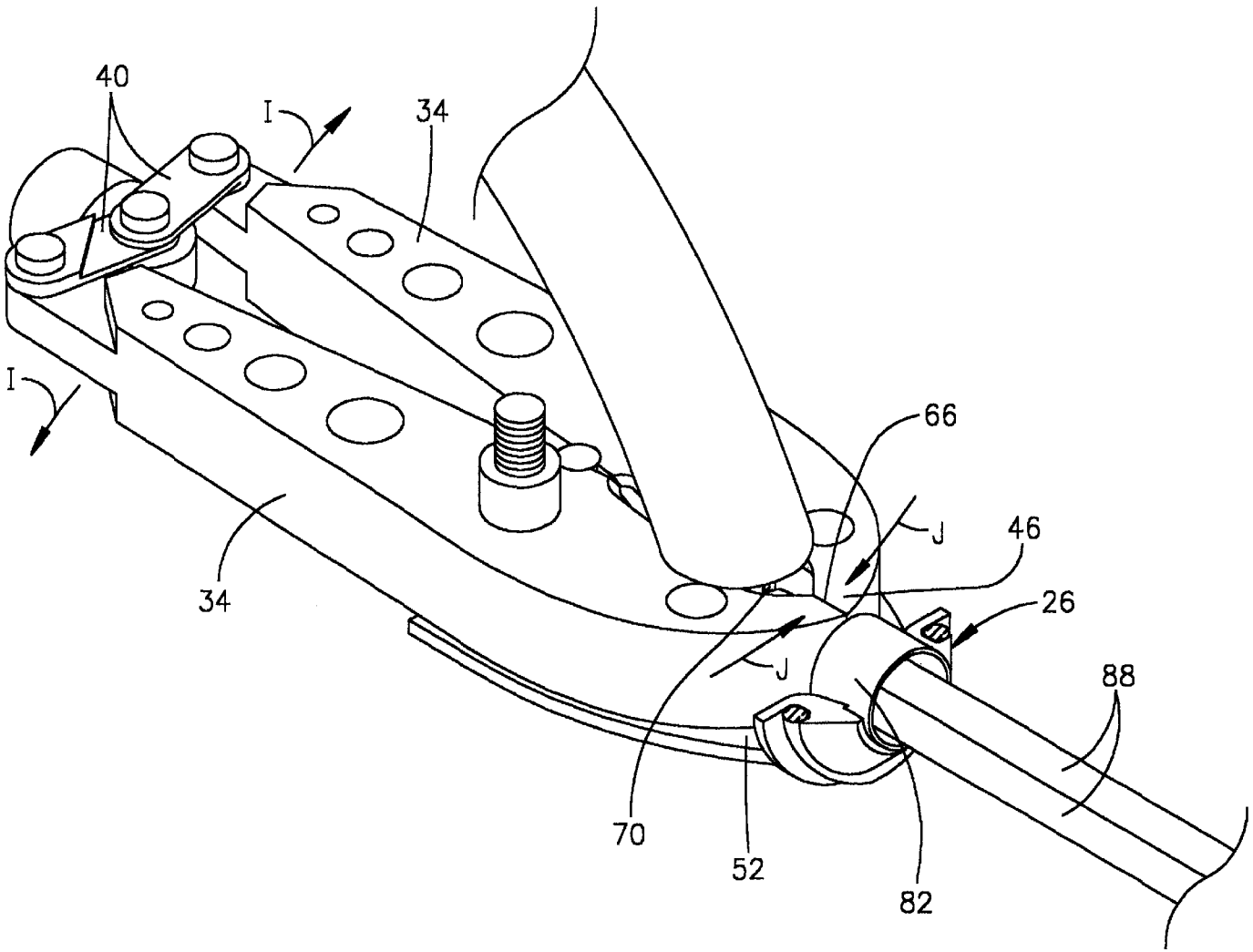

For purposes of further description of the sequence of operation, connector 82 which has been moved into crimping area 66 from staging area 64 in FIG. 5, will be considered the "first" connector hereinafter. With that understanding, FIG. 6 shows crimping arm 34 having been pivoted in the direction of arrows "I" (FIG. 3) to move crimping jaws 46 toward each other in the direction of arrows "J" while collet 26 holds first connector 82 in crimping area 66. It can be seen that the conductors of electrical wires 88 have been inserted into the connector, and the crimpable connector thereby is crimped on the conductors to mechanically and electrically join the conductors.

Figure 7:
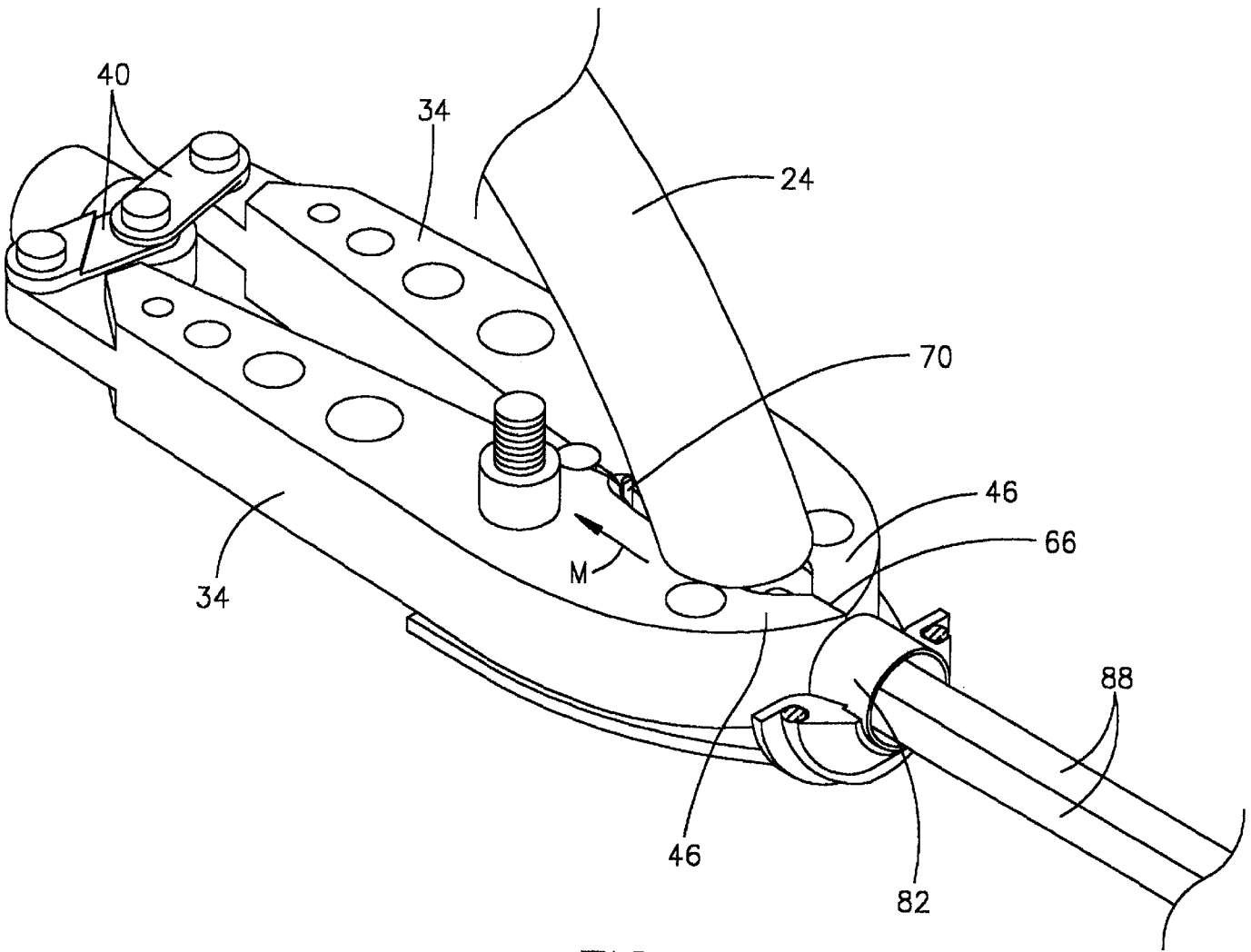

Referring to FIG. 7 in conjunction with FIG. 6, at about the time jaws 46 move from their loading positions (FIGS. 2 and 5) to their crimping positions (FIGS. 3 and 6), ejector pin 70 is moved by piston and cylinder device 72 (FIG. 4) in the direction of arrow "M" (FIG. 7) to a retracted position shown in FIG. 7. The ejector pin now is free or retracted out of staging area 64 between the crimping arms.

Figure 8:
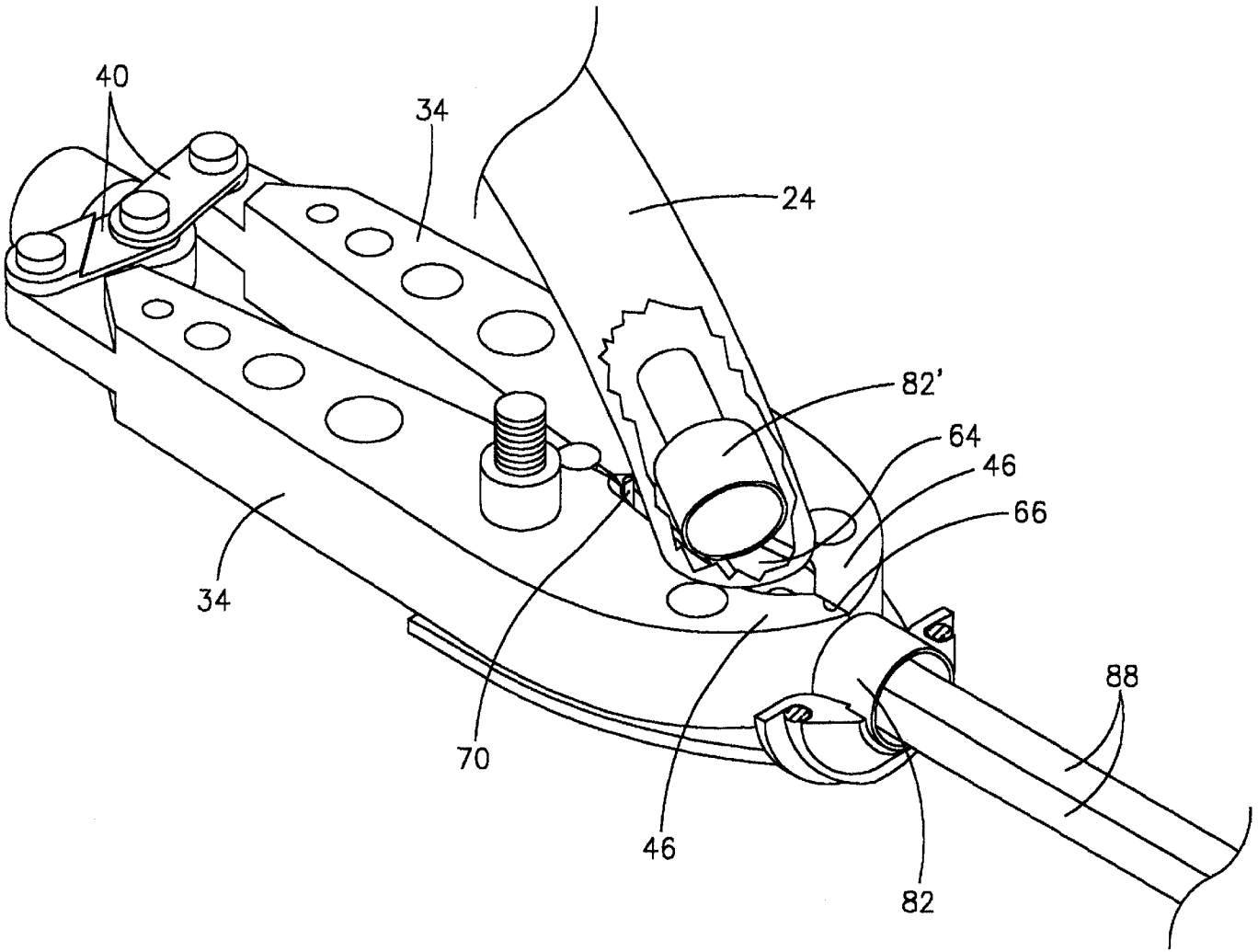

Referring to FIG. 8, with crimping arms 34 still in their closed position, with jaws 46 in their crimping position and with ejector pin 70 in its retracted position, a second connector 82' is fed through tube 24 toward staging area 64. However, it can be seen that with the crimping arms in their closed position, staging area 64 is too narrow for the second connector to drop therein to. Therefore, the second connector rests on top of the crimping arms immediately above the staging area ready to be fed downwardly thereinto.

Figure 9:
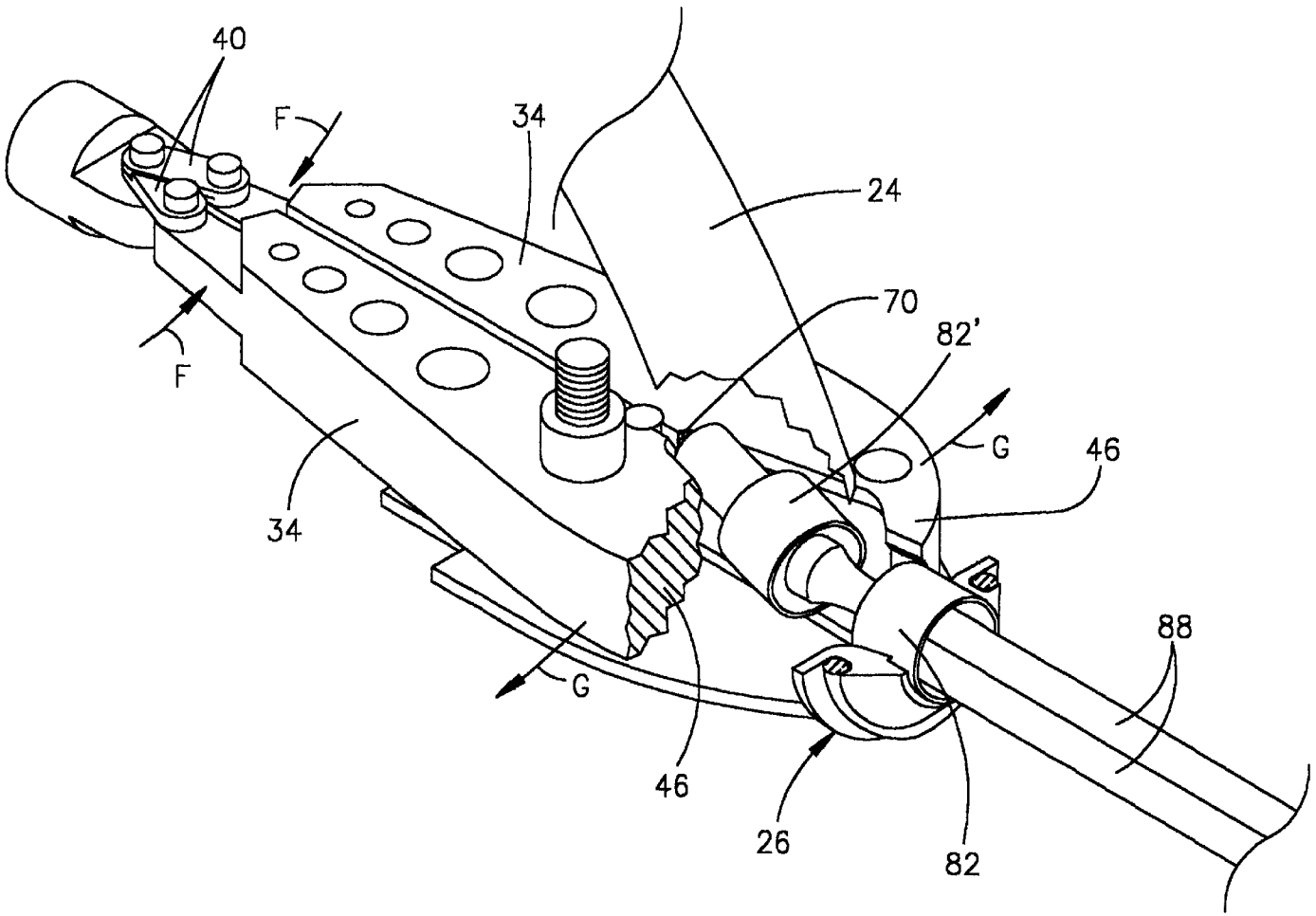

FIG. 9 shows crimping arms 34 having been pivoted in the direction of arrows "F" (FIG. 2) to their open position which moves jaws 46 outwardly in the direction of arrows "G" back to their loading position. It can be seen that staging area 64 now has been opened to allow second connector 82' to drop into the staging area immediately behind first connector 82 which now has been crimped to the conductors of electrical wires 88.

Figure 10:
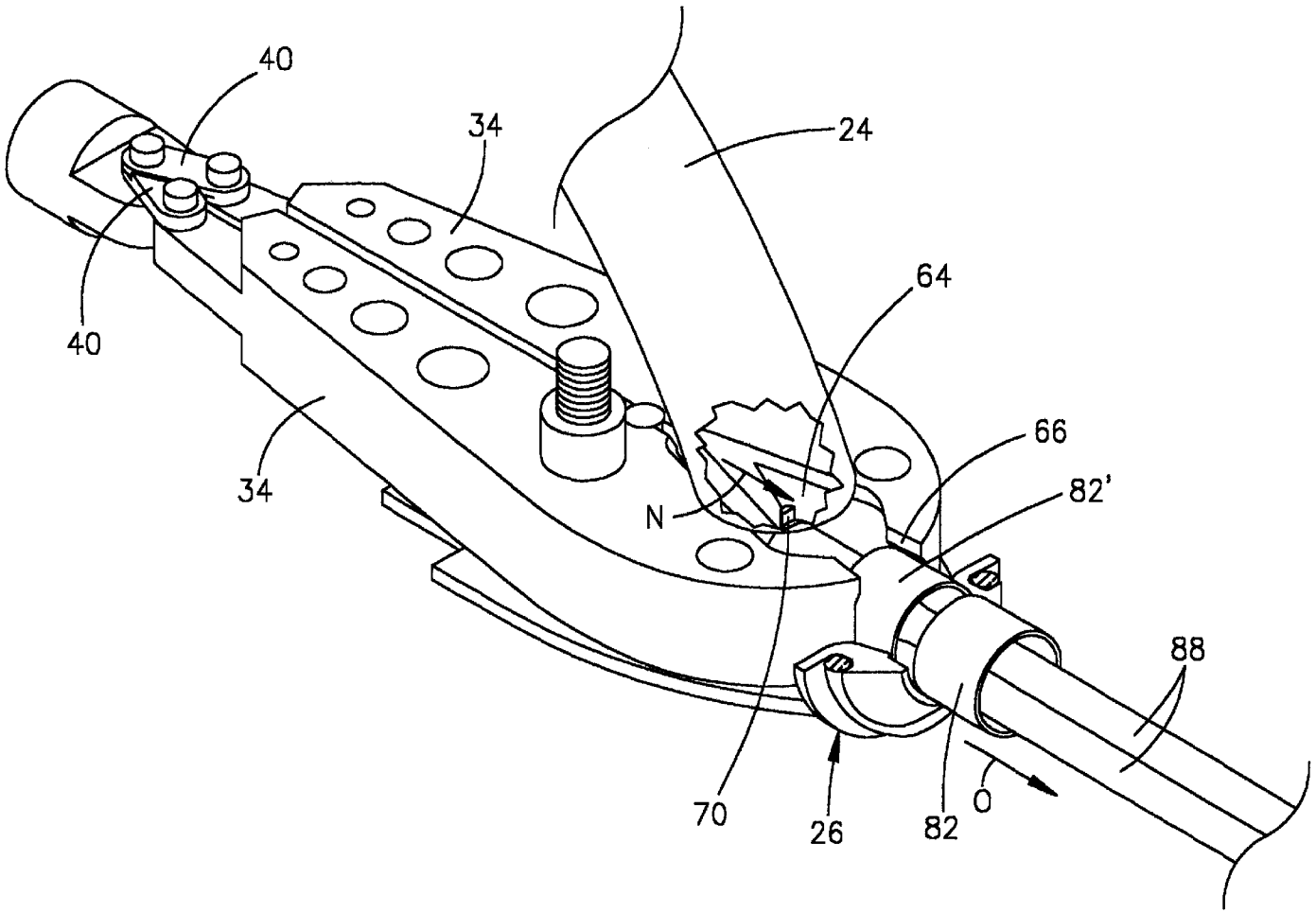

FIG. 10 is identical to FIG. 9, except that ejector pin 70 now has been moved into engagement with the rear end of second connector 82' to move the second connector in the direction of arrow "N" into engagement with first connector 82. This moves second connector 82' from staging area 64 into crimping area 66 and ejects first connector 82 from collet 26 in the direction of arrow "O".

Figure 11:
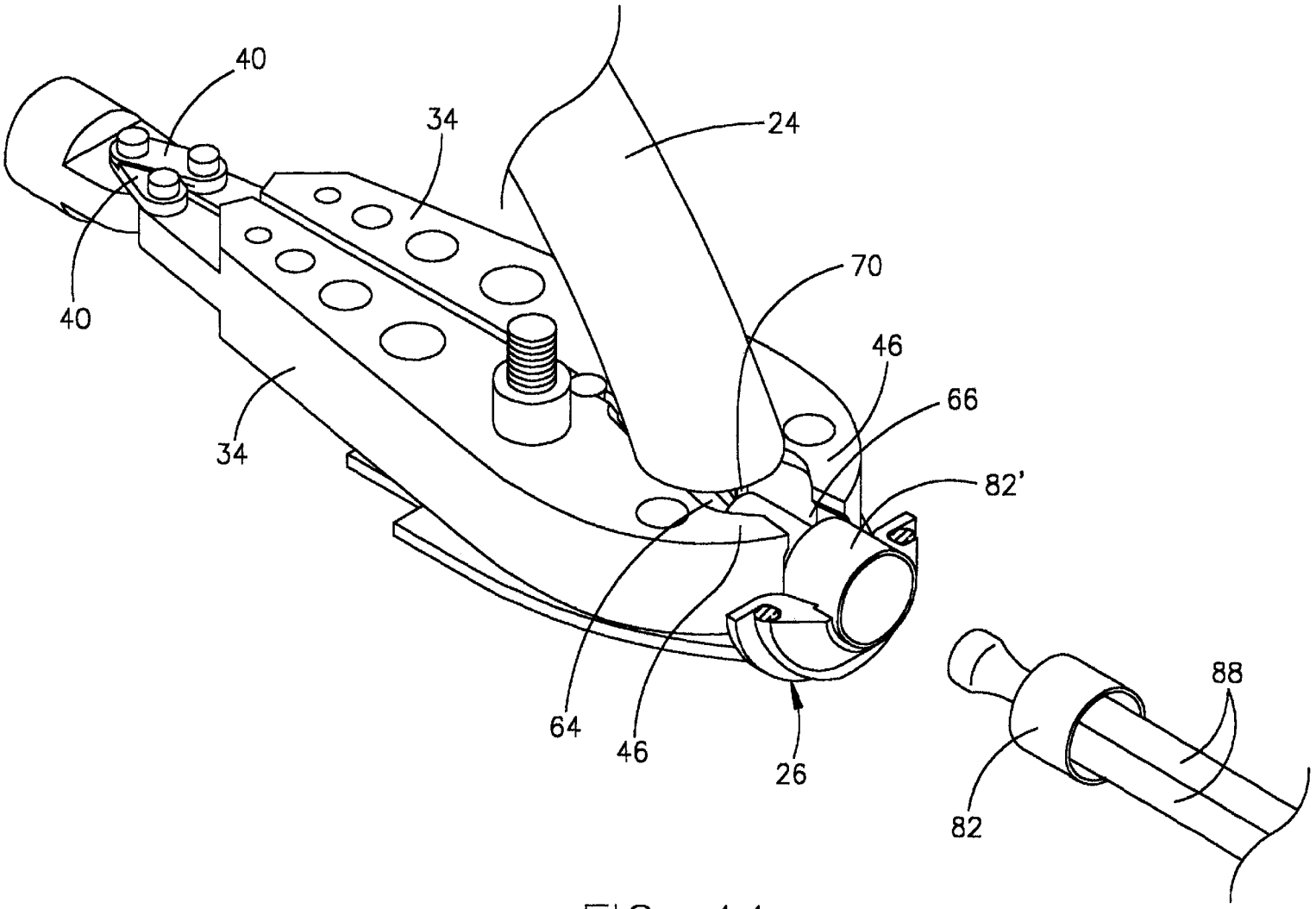
Figure 12:
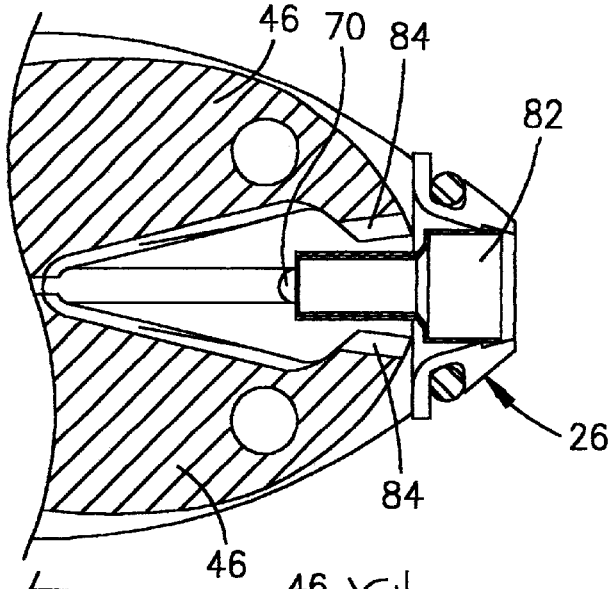
FIGS. 12–16 are sequential sectional views of the views shown in FIGS. 5–11.
Figure 13:
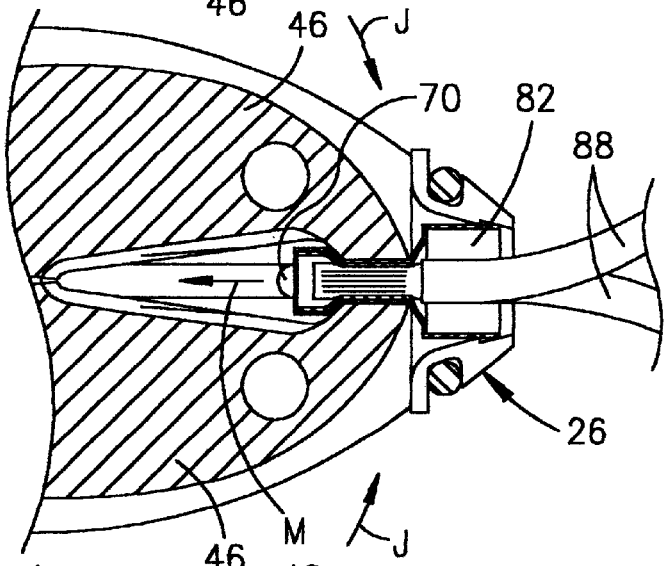

Referring to FIG. 11, the cycle of operation then can be repeated on second connector 82', as first connector 82 which has been crimped to the conductors of electrical wires 88 can be removed and/or ejected from the apparatus. In other words, FIG. 11 corresponds to FIG. 5, except for the existence of the filly crimped assembly of first connector 82 and electrical wires 88.

The entire cycle is started by an operator depressing actuator button 20 (FIG. 1). All of the operative components of the apparatus are actuated by pneumatic devices with are easily timed by variably time-set pneumatic needle valves as is well within the purvue of one skilled in the art. This includes the sequential operation of ejector pin 70 by pneumatic piston and cylinder device 72 and the pneumatic feeding of connectors through hollow tube 24 in a timed sequence with the opening and closing of crimping arms 34 and jaws 46. The operative mechanical components and assembly of apparatus 12 as described above is extremely simple in comparison to the prior art.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

Figure 14:
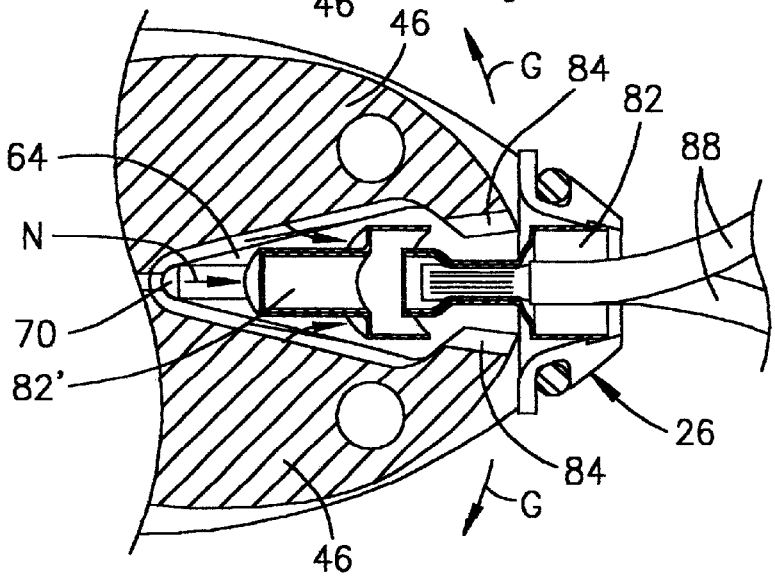
Figure 15:
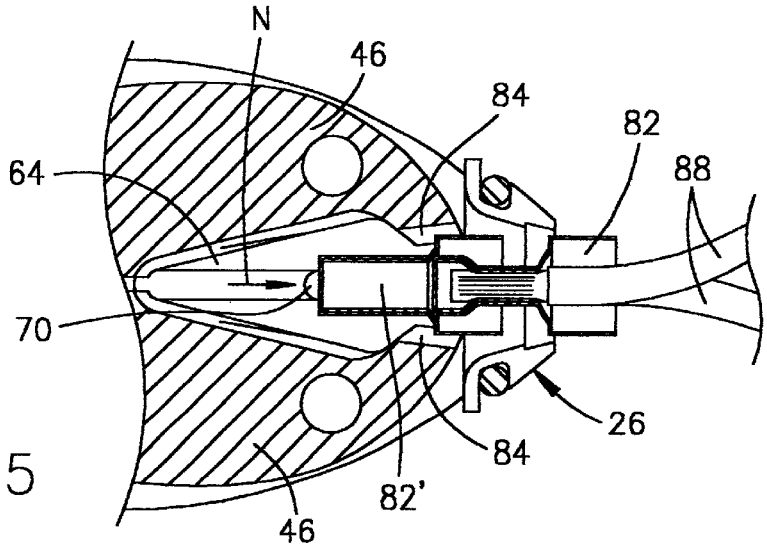
Figure 16:
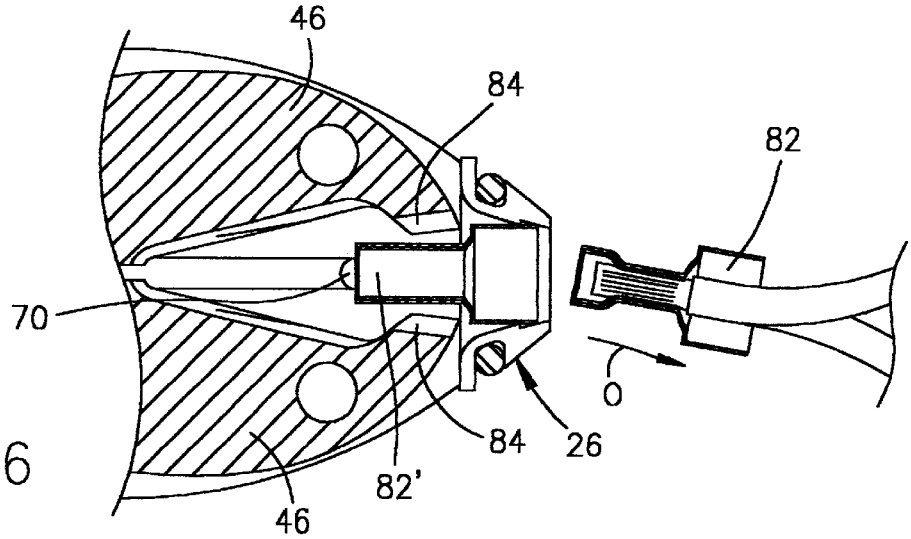

FIGS. 12 through 16 show various steps in the cycle in section view corresponding generally to FIGS. 5–11. FIGS. 9, 14 and 15 show the staging area 64 having adequate space for the second connector 82' to rotate out of the tube 24 and into sliding engagement with the first connector 82. FIGS. 14 and 15 show the open end of the second connector 82' in contact with the closed end of the first connector and FIGS. 12, 14–16 show the outer diameter of the open ends of both the first and second connectors having clearance to pass between the recessed portions 84 of the opened jaws 46.

What is claimed:

1. An apparatus in combination with a first and second crimpable connectors for crimping said crimpable connectors onto at least one electrical conductors, said connectors including a crimpable metal liner surrounded by a dielectric cup with a closed end and an open end, comprising:

a pair of crimping arms defining a staging area behind a crimping area, with a pair of opposing crimping jaws, operatively associated with the connectors, on opposite sides of the crimping area, the arms being movable between open and closed positions to move the jaws between loading and crimping positions, respectively, the arms in said open position (the loading position of the jaws) allowing a first connector to be fed from the staging area to the crimping area, and the arms in said closed position (the crimping position of the jaws) blocking the staging area to prevent a second connector from being fed there into while the first connector is being crimped;

means, operatively associated with the crimping arms, for moving the crimping arms between said positions;

means, operatively associated with the connectors, for feeding connectors seriatim to the staging area; and an ejector, operatively associated with the connectors, for engaging the closed end of the second connector fed to the staging area when the crimping arms are open and for moving the second connector from the staging area to the crimping area into engagement with the first connector where the open end of the second connector fits over the closed end of the first connector to eject the first connector from the crimping area while the second connector moves into the crimping area.

2. The apparatus in combination with the crimpable connectors of claim 1, including means, operatively associated with the crimping arms, for pivotally mounting said crimping arms on said apparatus for relative movement between said open and closed positions.

3. The apparatus in combination with the crimpable connectors of claim 1 wherein said staging area is defined by an open area between the crimping arms behind the opposing crimping jaws.

4. The apparatus in combination with the crimpable connectors of claim 3 wherein said open area is dimensioned to be narrower than one of the connectors when the crimping arms are in the closed position, the open area being at least as wide as one of the connectors when the crimping arms are in the open position.

5. The apparatus in combination with the crimpable connectors of claim 1 wherein said means, operatively associated with the crimping arms, for moving the crimping arms comprise a piston and a cylinder device.

6. The apparatus in combination with the crimpable connectors of claim 1, including means, operatively associated with the ejector, for moving the ejector from a retracted position to an extended position to effect moving the second connector from the staging area to the crimping area and ejecting the first connector from the crimping area, and moving the ejector back to the retracted position as the crimping arms are moved to their closed position to move the jaws into crimping position against the second connector.

7. The apparatus in combination with the crimpable connectors of claim 6 wherein said means, operatively associated with the ejector, for moving the ejector comprise a piston and a cylinder device.

8. The apparatus in combination with the crimpable connectors of claim 1 wherein said means, operatively associated with the connectors, for feeding the connectors include a hollow tube leading to the staging area.

9. The apparatus in combination with the crimpable connectors of claim 1, including a spring loaded collet, operatively associated with the connectors, at a front of the crimping area for releasably holding the first connector in the crimping area during crimping and to allow the first connector be pushed out of the collet by the second connector after crimping.

10. The apparatus in combination with the crimpable connectors of claim 9 wherein said spring loaded collect comprises a split collet surrounded by a resilient ring.

11. An apparatus in combination with a first and second crimpable connectors for crimping said crimpable connectors onto at least one electrical conductor said connectors including a crimpable metal liner surrounded by a dielectric cup with a closed end and an open end, comprising:

a pair of pivotally mounted crimping arms, operatively associated with the connectors, defining a staging area behind a crimping area, with a pair of opposing crimping jaws, operatively associated with the connectors, on opposite sides of the crimping area, the arms being pivotable between open and closed positions to move the jaws between loading and crimping positions, respectively, the staging area being defined by an open area between the crimping arms behind the opposing crimping jaws, the open area being at least as wide as one of the connectors when the crimping arms are in the open position to allow the first connector to be fed from the staging area to the crimping area, and the open area being dimensioned to be narrower than one of the connectors when the crimping arms are in the closed position to block the staging area to prevent a second connector from being fed there into while the first connector is being crimped;

means, operatively associated with the crimping arms, for moving the crimping arms between said positions;

means, operatively associated with the connectors, for feeding connectors seriatim to the staging area;

an ejector, operatively associated with the connectors, for engaging the closed end of the second connector fed to the staging area when the crimping arms are open and for moving the second connector from the staging area to the crimping area into engagement with the first connector where the open end of the second connector slips over the closed end of the first connector to eject the first connector from the crimping area while the second connector moves into the crimping area; and means, operatively associated with the connectors, for moving the ejector from a retracted position to an extended position to effect moving the second connector from the staging area to the crimping area and ejecting the first connector from the crimping area, and moving the ejector back to the retracted position as the crimping arms are moved to their closed position to move the jaws into crimping position against the second connector.

12. The apparatus in combination with the crimpable connectors of claim 11 wherein said means, operatively associated with the crimping arms, for moving the crimping arms comprise a piston and a cylinder device.

13. The apparatus in combination with the crimpable connectors of claim 11 wherein said means, operatively associated with the ejector, for moving the ejector comprise a piston and a cylinder device.

14. The apparatus in combination with the crimpable connectors of claim 11 wherein said means, operatively associated with the connectors, for feeding the connectors include a hollow tube leading to the staging area.

15. The apparatus in combination with the crimpable connectors of claim 11, including a spring loaded collet, operatively associated with the connectors, at a front of the crimping area for releasably holding the first connector in the crimping area during crimping and to allow the first connector be pushed out of the collet by the second connector after crimping.

16. The apparatus in combination with the crimpable connectors of claim 15 wherein said spring loaded collet comprises a split collet surrounded by a resilient ring.

* * * * *